US010184761B2

(12) United States Patent
Winter et al.

(10) Patent No.: US 10,184,761 B2
(45) Date of Patent: Jan. 22, 2019

(54) METHOD FOR PRODUCING ELECTRIC TRIGGER ELEMENTS FOR PYROTECHNIC ARTICLES

(71) Applicant: RUAG Ammotec GmbH, Fürth (DE)

(72) Inventors: Andreas Winter, Fürth (DE); Georg Ulrich, Fürth (DE)

(73) Assignee: RUAG AMMOTEC GMBH, Furth (DE)

( * ) Notice: Subject to any disclaimer, the term of this patent is extended or adjusted under 35 U.S.C. 154(b) by 0 days.

(21) Appl. No.: 15/109,243

(22) PCT Filed: Dec. 17, 2014

(86) PCT No.: PCT/EP2014/078163
§ 371 (c)(1),
(2) Date: Jun. 30, 2016

(87) PCT Pub. No.: WO2015/091612
PCT Pub. Date: Jun. 25, 2015

(65) Prior Publication Data
US 2016/0356579 A1 Dec. 8, 2016

(30) Foreign Application Priority Data
Dec. 19, 2013 (DE) ..... 10 2013 022 323

(51) Int. Cl.
*F42B 3/12* (2006.01)

(52) U.S. Cl.
CPC ..... *F42B 3/124* (2013.01)

(58) Field of Classification Search
CPC ..... F42B 13/124; F42B 13/12; F42B 3/124; F42B 3/12; F42B 3/128
USPC ..... 102/202, 202.2, 202.5–202.9, 202.11, 102/202.12
See application file for complete search history.

(56) References Cited

U.S. PATENT DOCUMENTS 4,840,122 A * 6/1989 Nerheim ..... F42B 3/13 102/202.5
5,732,634 A * 3/1998 Flickinger ..... F42B 3/125 102/202.14
6,199,484 B1 * 3/2001 Martinez-Tovar ..... F42B 3/13 102/202.4
8,250,978 B2 * 8/2012 Mukunoki ..... B60R 21/26 102/202.7
2002/0097137 A1 * 7/2002 Gerber ..... F42B 3/124 338/309
2004/0134371 A1 * 7/2004 Bernhard ..... F42B 3/124 102/202.7
2005/0224454 A1 10/2005 Gerber et al.
2009/0139422 A1 * 6/2009 Mohler ..... G11B 23/0035 102/364
2013/0133542 A1 * 5/2013 Morris ..... F42B 3/12 102/202.7

FOREIGN PATENT DOCUMENTS

DE 102 40 053 A1 3/2004
WO 02/057704 A1 7/2002
WO WO 02057704 A1 * 7/2002 ..... F42B 3/124
WO WO-02057704 A1 * 7/2002 ..... F42B 3/124

OTHER PUBLICATIONS

International Search Report for PCT/EP2014/078163 dated Mar. 9, 2015; English Translation submitted herewith (5 Pages).

* cited by examiner

*Primary Examiner* — John Cooper
(74) *Attorney, Agent, or Firm* — Fitch, Even, Tabin & Flannery, LLP

(57) ABSTRACT

The invention relates to a method for producing electric trigger elements for pyrotechnic articles such as fuses or igniters, wherein, in a first stage, a) a lacquer is applied by photolithography to an electrically non-conductive substrate, b) a conductive material having a specific resistance of 0.1 Ω*mm to 5.0 Ω*mm is applied to the lacquer and substrate by means of a PVD process in a layer thickness of 0.02 μm to 8.0 μm, and c) the lacquer is removed from the substrate, and possibly, in a second stage, d) a photolithographic process is again carried out in which a precisely defined region of the resistor strip is covered with photoresist, e) the entire substrate surface is covered with a layer of a metal having a specific resistance of 0.01 Ω*mm to 0.1 Ω*mm in a thickness of 0.1 μm to 20 μm, wherein the application of the metal is configured such that in regions which have a bare substrate from the first photolithographic process, no metal adheres, and f) the lacquer from the second photolithographic process is again removed.

24 Claims, No Drawings

METHOD FOR PRODUCING ELECTRIC TRIGGER ELEMENTS FOR PYROTECHNIC ARTICLES

CROSS-REFERENCE TO RELATED APPLICATIONS

This application is a U.S. national phase application filed under 35 U.S.C. § 371 of International Application No. PCT/EP2014/078163, filed Dec. 17, 2014, designating the United States, which claims priority from German Patent Application No. 10 2013 022 323.7, filed Dec. 19, 2013, which are hereby incorporated herein by reference in their entirety for all purposes.

The invention relates to a method for producing electric trigger elements for pyrotechnic articles such as fuses or igniters.

Electric trigger elements serve to initiate a primary explosive as the first member of a fuse or igniter chain. For this purpose, the heat generated which is emitted by a resistor through which a current flows is used. The primary explosive is in direct contact with the electric resistor and is initiated by reaching its deflagration temperature. The electric resistor can be configured, for example, in the form of a wire.

The production method relates to a special form of igniter element wherein the electric resistor is formed by a thin metal film on an insulating substrate surface. Trigger elements of this type have been in general use for many years. The resistor layer made of a metal with a high specific resistance is applied by a physical vapor deposition (PVD) process onto the substrate (e.g. ceramic or glass) and, if required, is reinforced remote from the well-defined resistor area by a further layer of a material with a high electrical conductivity. The geometry of the resistor area is adapted to the requirements of the use, in particular, in relation to the resistance value and the initiation characteristic (e.g. the required current strength). In established production methods, the form of the resistor area (the thickness of which is given by the layer thickness of the metal film) is generated by laser material machining on each individual component.

Due to the influence of the high laser power during the material machining, undesirable material changes can occur at the edges of the laser cut. These material changes (of both geometrical and substantial types) have negative effects on the initiation characteristics of the resistor layer. Additionally, the individual machining of each trigger element is very time-consuming.

It is an object of the invention to provide a new method for producing initial elements based on PVD layers that enables a clean configuration of the edges of the resistor layers. It is also desirable to reduce the manufacturing costs.

According to the invention, the object is achieved in that firstly a lacquer is applied by photolithography onto the substrate. This prevents a coating of the substrate in a large region, but leaves free a region of the substrate surface of precisely defined width. Subsequently, the PVD process is carried out on the lacquer and the substrate. By this means, an electrically conductive layer is produced between the two terminal poles of the trigger element. The lacquer is subsequently released from the substrate so that electrically non-conductive substrate and a resistor region of precisely defined width is obtained, through which the current can later flow from one terminal pole to the other. The thickness of the resistor layer is already set during the PVD process. In order to generate the length equally precisely, a photolithographic process is again carried out and a precisely defined region of the resistor strip is covered with lacquer. Subsequently, the entire substrate surface is covered with a relatively thick layer of readily conductive metal (e.g. by galvanic gilding). The application of the metal is configured so that in regions which have a bare substrate from the first photolithographic process, no metal adheres. Subsequently, the lacquer from the second photolithographic process is again removed. Due to the photoresist, a precisely defined region remains, which is formed only by the layer of metal with a high specific resistance. The first photolithographic process defines the width of the resistor layer and provides for insulation in the surrounding regions, the second process defines the length and the second layer provides for good electrical conductivity and good contact at the terminal poles. The PVD process itself defines the thickness of the resistor layer. For precise setting of the electric resistance, the PVD layer can originally be configured too thick and the thickness can be reduced by step-wise removal and thus the resistance can be set precisely.

If no reinforcement of the contact areas by additional readily conductive layers is required—the entire resistance geometry can be realized with a suitable photomask in a single lithographic process.

The invention relates to:

- a method for producing electric trigger elements for pyrotechnic articles, wherein in a first stage
  - a) a lacquer is applied by photolithography to an electrically non-conductive substrate,
  - b) a conductive material having a specific resistance of 0.1 Ω*μm to 5.0 Ω*μm is applied to the lacquer and substrate by means of a PVD process in a layer thickness of 0.02 μm to 8.0 μm, and
  - c) the lacquer is removed from the substrate and possibly, in a second stage,
  - d) a photolithographic process is again carried out in which a precisely defined region of the resistor strip is covered with photoresist,
  - e) the entire substrate surface is covered with a layer of a metal having a specific resistance of 0.01 Ω*μm to 0.1 Ω*μm in a thickness of 0.1 μm to 20 μm, wherein the application of the metal is configured such that in regions which have a bare substrate from the first photolithographic process, no metal adheres, and
  - f) the lacquer from the second photolithographic process is again removed;
- a method in which, in the first stage, the width of the resistor layer is defined by the photolithographic process and insulation is provided in the surrounding regions;
- a method in which, in the second stage, the length of the resistor layer is defined by the photolithographic process;
- a method in which a conductive material having a specific resistance of 0.1 Ω*μm to 5.0 Ω*μm is applied by means of the PVD process in a layer thickness of 0.02 μm to 8.0 μm, and in step b) the thickness of the resistor layer is defined;
- a method in which the layer applied in step b) is applied at a thickness exceeding the desired resistance value and by step-wise removal, the thickness is reduced and thereby the resistance is precisely set;
- a method in which, in the event that no reinforcement of the contact surfaces by means of additional readily conductive layers is required, the entire resistor geometry is realized with a photomask in a single lithographic process;

a method wherein possibly in step e) an electrically readily conductive layer is applied;

the use of the method for producing pyrotechnic trigger elements, and thus the photolithographic creation of resistor layers with precisely defined geometry on a non-conductive substrate, the stipulation of the length and width of the resistor layer by using photomasks for specific curing of photoresist, and the use of the production method described for pyrotechnic trigger elements.

The special advantages of this method lie therein that very precisely defined edges of the resistor film come about and the material is homogeneous over the entire resistor area (no material changes due to point-wise heat effects as with laser machining). Furthermore, using photomasks, the resistor can be applied simultaneously for very many trigger elements and the parts must be separated at a later time point in the production process, which makes the process quicker and more economic than conventional methods.

The invention claimed is:

1. A method for producing electric trigger elements for pyrotechnic articles, comprising, in a first stage, a) a coating is applied to defined regions of an electrically non-conductive substrate by photolithography, b) a conductive material is applied to the coating and substrate by means of a PVD process in a layer thickness of 0.02 μm to 8.0 μm, and c) the coating is removed from the substrate to provide a resistor strip; and, in a second stage, d) a photolithographic process is again carried out in which a precisely defined region of the resistor strip is covered with a second coating, e) the entire substrate surface is covered with a layer of a metal in a thickness of 0.1 μm to 20 μm, wherein the application of the metal is configured such that in regions which have a bare substrate from the first photolithographic process, no metal adheres, and f) the second coating from the second photolithographic process is again removed.

2. The method as claimed in claim 1, wherein the first and second stage provide a resistor layer having a width defined by the photolithographic process in the first stage, and insulation is provided in the surrounding regions.

3. The method as claimed in claim 2, wherein a length of the resistor layer is defined by the photolithographic process in the second stage.

4. The method as claimed in claim 3, wherein a thickness of the resistor layer is determined by the PVD process in step b).

5. The method as claimed in claim 1, wherein the conductive material applied in step b) is configured in a thickness exceeding the desired resistance value and by step-wise removal, the thickness is reduced and thereby the resistance is precisely set.

6. The method as claimed in claim 1, wherein, in step e), a readily conductive layer is applied.

7. The method as claimed in claim 1, wherein the first and second stages provide a resistor layer having a length defined by the photolithographic process in the second stage.

8. The method as claimed in claim 7, wherein a thickness of the resistor layer is determined by the PVD process in step b).

9. The method as claimed in claim 1, wherein the first and second stages provide a resistor layer having a thickness determined by the PVD process in step b).

10. The method as claimed in claim 1, wherein the coating applied in step a) is a photoresist.

11. The method as claimed in claim 10, wherein the second coating applied in step d) is a photoresist.

12. The method as claimed in claim 1, wherein the second coating applied in step d) is a photoresist.

13. The method as claimed in claim 1, wherein the conductive material has a specific resistance of 0.1 Ω*μm to 5.0 •*μm.

14. The method as claimed in claim 13, wherein the metal has a specific resistance of 0.01 Ω*μm to 0.1 •*μm.

15. The method as claimed in claim 1, wherein the metal has a specific resistance of 0.01 Ω*μm to 0.1 •*μm.

16. The method as claimed in claim 1, wherein the entire substrate surface is covered with a layer of a metal in a thickness of 0.1 μm to 20 μm by galvanic gilding.

17. A method for producing electric trigger elements for pyrotechnic articles, comprising:

applying a lacquer in a first photolithography step onto an electrically non-conductive substrate such as to substantially coat a large region of the substrate but leaving free a region of the substrate surface of precisely defined width;

using a PVD process to apply an electrically conductive layer onto the lacquer-coated and uncoated regions of the substrate;

removing the lacquer coating and thereto adhering electrically conducting layer from the substrate thereby obtaining an electrically conductive resistor layer on the substrate of precisely defined width and having a suitably high specific resistance through which electric current can flow from a first to a second terminal pole of the trigger element at the substrate;

applying a photoresist in a second photolithography step onto a precisely defined region of the resistor layer to define a length of the resistor layer;

covering the entire substrate surface with a relatively thick layer of readily conductive metal, whereby the application of the metal is configured so that no metal adheres in regions which have a bare substrate from the first lithographic step; and removing the photoresist from the second photolithographic process, whereby a precisely defined resistor region remains which is formed by the conductive layer with high specific resistance, the first photolithographic step setting the width of the resistor layer and providing for insulation in the surrounding regions, the second photolithographic step setting the length of the resistor layer and enabling through the layer of conductive metal good electrical conductivity and good contact at the terminal poles.

18. The method as claimed in claim 17, wherein a final thickness of the resistor layer is set using the PVD process.

19. The method as claimed in claim 17, wherein the PVD-applied electrically conductive layer is applied in excess thickness and the thickness is subsequently reduced by step-wise removal of excess electrically conductive layer for precise setting of the electric resistance of the resistor layer.

20. The method as claimed in claim 17, wherein the readily conductive metal is applied using galvanic gilding.

21. The method as claimed in claim 17, wherein the conductive material has a specific resistance of 0.1 Ω*μm to 5.0 Ω*μm.

22. The method as claimed in claim 21, wherein the metal has a specific resistance of 0.01 Ω*μm to 0.1 Ω*μm.

23. The method as claimed in claim 17, wherein the metal has a specific resistance of 0.01 Ω*μm to 0.1 Ω*μm.

24. The method as claimed in claim 17, wherein the conductive material resistor layer has a thickness of 0.02 μm to 8.0 μm and/or the conductive metal layer has a thickness of 0.1 μm to 20 μm.

* * * * *